United States Patent [19]

Meinhardt

[11] Patent Number: 4,806,108

[45] Date of Patent: Feb. 21, 1989

[54] GROUNDING BUSHING

[76] Inventor: Ben W. Meinhardt, 6615 Highway 12, Maple Plain, Minn. 55359

[21] Appl. No.: 417,057

[22] Filed: Sep. 13, 1982

[51] Int. Cl.[4] ..... H01R 4/66

[52] U.S. Cl. ..... 439/100; 439/814

[58] Field of Search ..... 339/14 R, 14 L, 13, 339/272 R; 439/100, 814

[56] References Cited

U.S. PATENT DOCUMENTS

| | | | |
|---|---|---|---|
| 2,710,381 | 6/1955 | Monson | 339/14 L |
| 2,974,185 | 3/1961 | Curtiss | 174/51 |
| 3,006,981 | 10/1961 | Weber | 174/65 |
| 3,365,693 | 1/1968 | Browne | 339/272 R X |
| 3,492,625 | 1/1970 | Bromberg | 339/272 R X |
| 3,967,872 | 7/1976 | Mooney et al. | 339/143 |
| 4,159,859 | 7/1979 | Shemtov | 339/14 |
| 4,189,198 | 2/1980 | Reichman | 339/13 |
| 4,210,374 | 7/1980 | Churla | 339/14 |

OTHER PUBLICATIONS

Advertisement "Lay∝In-Lug" from O-Z/Gedney, Terryville, Conn., 08786.

Advertisement "Beavertooth" from Atlas Technologies Inc., Scranton, Pa., 18509.

Advertisement "Efcor" from Gould Inc., Electrical Components Division, E. Farmingdale, N.Y., 11735.

Advertisement "Midwest Lazy-Lug" from Midwest Electric Mfg. Co., Chicago, Ill., 60612.

*Primary Examiner*—Eugene F. Desmond

*Attorney, Agent, or Firm*—Kinney & Lange

[57] ABSTRACT

A grounding bushing and ground conductor attaching lug assembly comprises an annular bushing with a plurality of ears or bosses rasied from the outer surface of the bushing, and each of the ears or lugs has a planar top surface that defines a plane inclined with respect to the central axis of the bushing. Thus when the bushing is tightened in place on a conduit in an electrical panel or box, the outer surface of at least one of these ears or bosses is accessible from the opening of the panel. The grounding lug is adapted to mate with the surface of each boss or ear. Each of the bosses has a tapped opening so that the grounding lug can easily be connected with a screw to its respective boss. The grounding lug has a conductor receiving slot which is readily accessible from the exterior of the box. The grounding conductor is easily inserted and held securely in place. Because each of the bosses on the exterior of the grounding bushing is drilled and tapped to receive a screw for supporting the lug, and the axis of the tapped thread is perpendicular to the inclined surface of the boss, a grounding lug can be easily attached no matter where the busing tightens down on a conduit because there will alsways be at least one boss that is accessible for attachment of the grounding lug.

2 Claims, 1 Drawing Sheet

GROUNDING BUSHING

CROSS REFERENCE TO RELATED APPLICATIONS

Reference is made to co-pending U.S. design patent application of the present inventor, Ser. No. 417,109, filed Sept. 13, 1982, for Design of Grounding Bushing; and co-pending design patent application Ser. No. 456,669, filed Jan. 10, 1983, for Design for Lug for Securing Electrical Ground Wire.

BACKGROUND OF THE INVENTION

1. Field of the Invention.

The present invention relates to grounding bushings that are used with conduits in electrical panels and which include lugs for receiving a grounding conductor which must be secured to the bushing.

2. Description of the Prior Art.

Various grounding bushings have been advanced and used. These grounding bushings include various coupling lugs for ground wires of different configurations, but the problem of easy and secure attachment of a grounding bushing for installing the grounding lug and attaching the grounding conductor when the bushing is in place on a conduit on the inside of an electrical panel or box remains.

Grounding bushings on the market cannot always be turned on or threaded onto the conduit tightly and still use the provided grounding lug. Some types of bushings have a protruding grounding lug on the outside and that makes it impossible to turn the bushing onto the threads at all, particularly when the conduit is placed near a corner of the electrical panel or box. If the lug is removed from the bushing before turning it on, many times it cannot be replaced again after the bushing has been fully tightened on the conduit because the position for attaching the lug on the bushing may be closely adjacent to a side wall of the box, or otherwise inaccessible in the box. When the bushing is turned on tight with the lug attached, the lug always seems to be facing in such a direction that the grounding conductor cannot be placed into the lug, or where the lug cannot be drawn down tight onto the conductor. Usually the reason the lug cannot be drawn down tight is that the screwdriver that is necessary for tightening the screw against the grounding conductor cannot be placed in line or in axis with the screw. If the bushing is backed off or unthreaded to a point where the lug is accessible, grounding that is supposed to be accomplished through the set screw that ties the bushing into place is questionable. Many times the set screws are so small the electrician does not have a small enough screwdriver to tighten down the set screw securely, if he is able to get at it at all.

Additionally, many of the grounding lugs are of the "tunnel" type where the electrician must thread the grounding conductor through a hole in the lug, which consumes unnecessary time and often kinks and damages the grounding conductor itself. After the grounding conductor has finally been secured into the tunnel lug, the lug is usually loosened up on the bushing. With the grounding conductor in place the lug cannot be retightened onto the bushing because in most cases the grounding conductor passes directly in front of the head of the screws which hold the lug onto the grounding bushing.

While some of the grounding devices have a "lay in lug" the inability to move the lug to different positions on the bushing easily forces the electrician to attach the grounding conductor wherever the lug happens to rest when the bushing is turned on tight. These problems and others described in the following prior art are overcome with the present device.

U. S. Pat. No. 4,189,198 shows a conduit ground wire coupling that has a grounding lug attachable thereto, and which has a multiple number of positions at which the grounding lug can be attached. However, the screws for attaching the grounding lug are positioned so that when the grounding lug is to be installed, the short stubby screw cannot be reached easily with a screwdriver for fastening. Also, because the grounding lug itself will shield the screw that holds it in place from view, it is difficult to keep the screwdriver in place.

U.S. Pat. No. 4,210,374 also shows a bushing including an integral electrical clamp for a ground wire. Integral clamps make it almost impossible to rotate the bushing in place on threaded conduit connections, and while U.S. Pat. No. 4,210,374 shows a slip-on bushing, this still involves the need for access from two distinct angles. Further there is a need for fastening the bushing and the grounding conductor which is many times inaccessible as well.

U.S. Pat. No. 4,159,859 shows a cradle-type ground lug which is attached in place with a set screw, but the ground lug is shown in an awkward position for installing any type of a ground conductor. Thus using the bushing is extremely difficult, even though the bushing itself in this particular patent shows a plurality of tapped holes, one on each of the conventional, flat outer surface bosses on the outside periphery of the grounding bushing.

A patent that shows a grounding bushing that has an inclined, forwardly facing surface on a boss on its periphery is U.S. Pat. No. 2,974,185. However, use of this type of a bushing is limited to number 10 American Wire Gauge or smaller. Using this type of a bushing in communication with a lug that will receive a grounding conductor simply and easily is not shown or suggested. Accessibility of a boss as well as turning it on remain problems when the device is installed in an electrical box.

A cradle-type ground lug for a conduit is also shown in U.S. Pat. No. 3,967,872, and this particular ground lug spans two bosses on the outside of a grounding bushing, but is only capable of being installed in one location on the bushing, and thus installation at many times will be difficult and further the grounding lug connections are not very secure. The set screw shown at 41 is not accessible after the grounding conductor is in place. The grounding bushing requires access at two points 90° apart.

A square throat cable connector having inclined bosses that are drilled and tapped to receive clips are shown in U. S. Pat. No. 3,006,981. This cable connector does not have the ruggedness and strength required for a grounding lug. Commercially available grounding bushings conform generally to the teaching of this prior art.

In all of the prior art, the difficulties of accessibility, ease of installation and obtaining proper grounding connections remain.

SUMMARY OF THE INVENTION

The present invention relates to a grounding bushing having a plurality of bosses around its outer periphery, preferably more than four in number, and each of the bosses having a flat surface that is inclined with respect to the axis of the bushing so that when in place, the surface faces outwardly from a wall of an electrical panel or box. This inclined surface is used for supporting a grounding conductor lug attached with a screw which is threaded into a hole which is drilled and tapped into the boss perpendicular to the surface. The screw is thus actually inclined away from the back wall of a panel or electrical box. The screw is readily accessible regardless of the rotational position of the bushing, because it tilts or inclines outwardly from the wall of the box, so that it can be easily connected with a screwdriver.

A ground conductor lug is adapted to sit flat on the inclined surface of the selected boss and is attached thereto by a screw being threaded into a drilled and tapped hole. The lug is of the type that receives the ground conductor through a front opening slot and is made strong enough so that when a grounding screw to hold the ground conductor in place is tightened, it can be tightened securely to make a good ground connection.

In combination, the bushing and lug work to simplify the electrician's job and insure that satisfactory grounding is achieved.

DETAILED DESCRIPTION OF THE PREFERRED EMBODIMENTS

Figure 1:
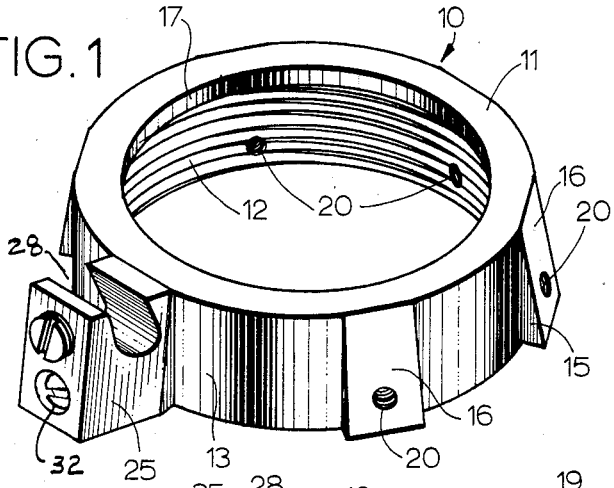
FIG. 1 is a perspective view of a grounding bushing having a grounding lug installed thereon and made according to the present invention.

The grounding bushing indicated at 10 comprises an annular band 11, which has a threaded inner surface 12 as shown in FIG. 1 in one form of the invention, and an outer surface 13 which is annular or cylindrical and is generated about a central axis that will coincide with the axis of a conduit on which the grounding bushing 10 is used. Grounding bushings such as that shown at 10 are used in connection with electrical systems for proper grounding of the system using a separate ground wire or conductor. The bushing 10 has a plurality of raised bosses 15 positioned to the exterior of surface 13, and as shown, positioned every 60° (there are six of them). Bosses 15 each have upper planar surfaces 16 which incline, as shown, so that they taper to a greater radial distance from the bushing central axis in direction from the front lip or edge 17 of the bushing toward the back edge.

The angle of inclination is selected to provide a tilt or inclination that is satisfactory for easy access to set screws that thereafter mount in threaded openings indicated generally at 20 that are provided in each of the bosses 15. The axis of the openings 20 are made perpendicular to the respective surfaces 16, so that the axes of the openings 20 are inclined relative to the central axis 19 of the bushing, and thus the upper or outer (head) end of any screw in an opening 20 is spaced farther away from the back edge indicated at 21 of the bushing 10 than the lower end of the screw.

Figure 5:
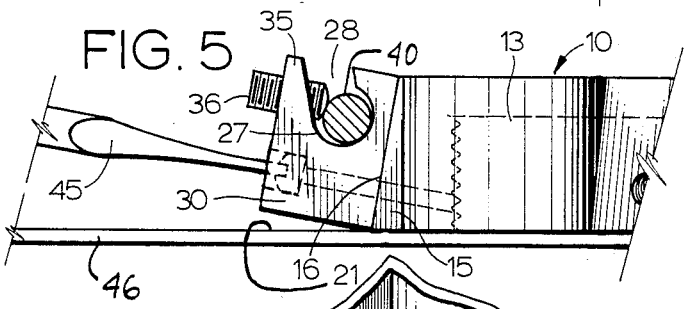
FIG. 5 is a fragmentary enlarged side view of the grounding bushing of FIG. 1 and the grounding lug connected thereto.

It can be seen, therefore, that the bosses or ears 15 are provided in conventional locations for grounding bushings. The bushing, of course, is made out of a suitable metal that conducts electricity and permits grounding, and when being installed, the bushing can be threaded into place and the ears can be used for driving the bushing tight on the threads of a conduit end to lock it securely. At least one of the selected ears 15 will be positioned so that a grounding lug indicated at 25 can be mounted on the surface 16 that is properly located. The lug 25 has a bottom surface 26 that mates with surface 16 and is the same size and shape for secure mounting on surface 16. The lug has a receptacle 27 adjacent one side thereof opening through a passageway 28 open to the front of the lug when it is installed properly on a bushing as shown in FIG. 5. In addition, the lug 25 has a throat portion 30 that has a passageway 31 therethrough for receiving rotatably a screw 32. The screw 32 has a fillister head (a deep slot is part of a fillister head) that is positioned in a recess 33 that is of larger diameter than the opening for the screw body and receives the screw head, and which is of sufficient depth so that it is deeper than the screw head.

Figure 6:
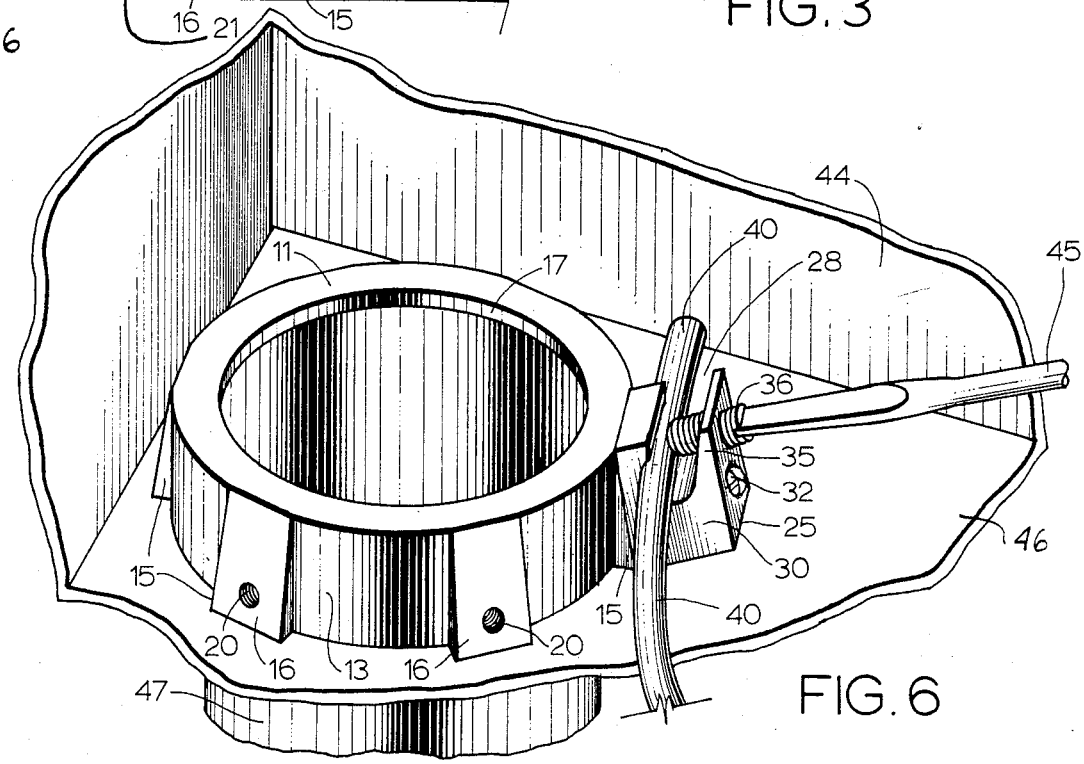
FIG. 6 is a fragmentary perspective view of an electrical panel or box showing the grounding bushing and grounding lug of the present invention installed on the end of a conduit in such electrical panel or box.

Additionally, the lug 25 has an overhanging lip 35 that overlies the passageway 28 and this lip 35 has a screw 36 threaded therethrough which is of size to engage and bear against a grounding wire 40 that is positioned in the receptacle 27. The screw 36 is parallel to screw 32.

Where the lug 25 is to be installed on one of the ears 15, it is placed on the surface 16 with its surface 26 mating thereon, and the screw 32 is properly located in the provided tapped hole 20.A screwdriver 45 (FIG. 5) can easily be inserted into the slot of the fillister head and is guided in place in the slot of fillister head by the surfaces of recessed 35 when the screw is being first installed. It can be noted that the screwdriver will taper away from the plane of the back surface 21 of the bushing (note FIGS. 5 and 6), and thus when the unit is installed in an electrical panel or box 44, for example, as shown in FIG. 6, the screwdriver shown at 45, when aligned with the screw, will be tilted away from the back wall 46 of the box when the screw 32 or screw 36 is to be tightened. The lug 25 can be made so that it is aligned with the sides of the boss 15 on which it is mounted, to make a compact installation, and the screw 32 can be tightened on very securely because the screwdriver has good leverage in that it extends away from all walls. The screw is readily accessible and the head can be seen by the electrician. The angle of inclination of the screw 32 and 36 relative to the plane of back surface 21 of the bushing (and through the back wall of an electrical box) is about 15°, thus the angle of inclination of surface 16 relative to axis 19 is about 15°.

Not only that, the screwdriver bit of the screwdriver 45 is piloted or held in the recess 33 as it rests in the slot of the fillister head screw 32 and the screw 32 can be tightened down very securely. The sloping of the screwdriver outwardly away from the back of the box wall or panel wall 46 permits a substantial amount of torque to be applied.

Then, when a ground wire 40 is to be installed, it can be slipped in through the throat 28, extending across the grounding lug of grounding bushing 10 and then fastened in place by threading down the screw 36 also using a screwdriver. Screw 36 is likewise to the front of the lug and can easily be seen, easily operated, and also inclined so that the screwdriver 45 inclines away from the back wall 46 when tightening this screw. Thus, both the screws holding the lug in place can be very securely fastened for a good grounding connection.

The fact that there are six ears 15, and each with an inclined surface for mounting one of the grounding lugs 25 insures that no matter where a bushing stops when it is installed on a conduit 47 as shown in FIG. 6, it will be one of the surfaces 16 readily accessible from the opening in the panel or box 44. Insulating collars or bushings may be used with the grounding bushing, as in conventional bushings. Screw 32 when tightened, penetrates into conduit 47 insuring maximum electrical continuity between grounding lug 25, bushing 10 and conduit 47.

Figure 7:
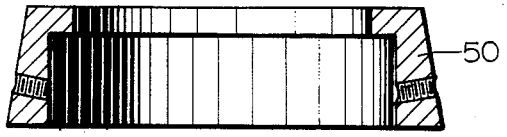
FIG. 7 is a sectional view through a modified form of the grounding bushing.
Figure 2:
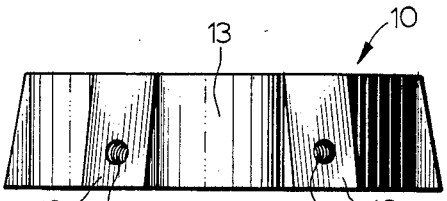
FIG. 2 is a side elevational view of the device of FIG. 1 with the grounding lug removed.
Figure 4:
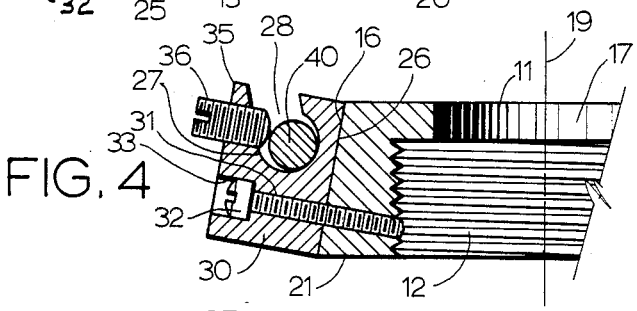
FIG. 4 is a sectional view through the grounding lug and a portion of the grounding bushing of FIG. 1.
Figure 3:
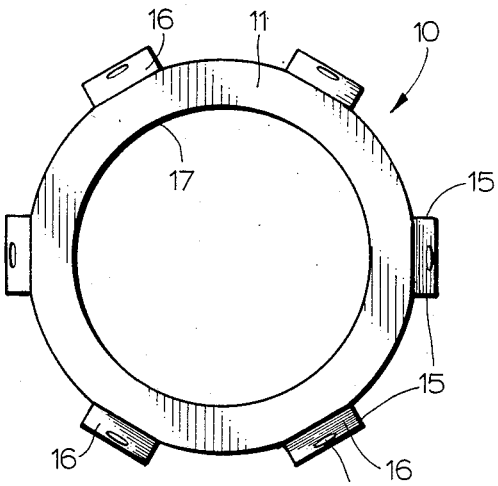
FIG. 3 is a top plan view of the grounding bushing of FIG. 1.

In FIG. 7, a modified form of the invention is shown which does not have the threads, but is a slip-on, set screw type grounding bushing 50. Set screws can be passed through the threaded openings 20 of more than one or two of the bosses 15, if desired, and another one or more of the bosses can be used for supporting ground lug 25 that is to be used. Other than that, the bushing 50 is substantially the same as the previous form of the bushing.

The set screw 32 can be selected at a length to engage the threads of the threaded conduit, to lock the bushing in place, and additionally in the modified form shown in FIG. 7, the set screw used for fastening a lug 25 in place on the respective bosses would be of sufficient length to engage the conduit wall and tightly force the bushing into place so that it was bonded well to the conduit wall and held in place with the set screw.

What is claimed is:

1. A grounding bushing and grounding lug combination comprising an annular bushing body having an inner and an outer surface and a front and a rear surface, said inner surface fitting over a conduit, a plurality of more than four bosses raised from the outer surface thereof at spaced annular locations, said bosses each having a generally planar surface forming an angle with respect to the central axis of the annular bushing body, and increasing in distance from the central axis in direction from the front of the bushing body to the rear of the bushing body, a threaded screw opening extending through each of said bosses from the planar surface of the boss to the interior surface of the bushing body, each threaded screw opening having an axis which is generally perpendicular to the plane of the outer surface of its associated boss and therefore inclined in direction toward the front of the bushing as the axis extends outwardly from the bushing, said grounding lug comprising a block having a front end and a rear end and having a first generally planar surface extending between the ends of the block that mates against an outer surface of one of the bosses on said bushing, said block having a second planar outer surface substantially parallel to the first planar surface and extending as a plane from the front to the rear ends, an aperture passing through the block extending from the second surface to the first surface and having a countersunk recess surrounding the aperture and opening to the second surface, first screw means passing through said block and engaging the threaded opening of the associated boss to hold the block in position on such boss, the first screw means having a head fitting in said recess, a receptacle formed in said block between said first and second surfaces of size to receive a conductor, said block having an opening from the receptacle on the outer end between the first and second surfaces and facing toward the outer end of the bushing and defined by an overlying lip portion positioned outwardly of the opening and providing an outer wall defining the upper edge of the opening and part of the receptacle, the first surface of the block being of size substantially the same as the boss planar surface so the outer end does not extend substantially beyond the front surface of the bushing when the first screw means is positioned in one of the threaded openings of the bushing to hold the block in a working position, and second screw means generally parallel to said first screw means passing through the second surface and the overlying lip portion and adapted to engage a conductor resting in the receptacle of said grounding lug.

2. The bushing of claim 1 wherein the boss planar surfaces form an included angle of about 15° with respect to the bushing axis.

* * * * *